US010213014B2

(12) United States Patent
Kumpf et al.

(10) Patent No.: US 10,213,014 B2
(45) Date of Patent: Feb. 26, 2019

(54) TRANSFER STATION FOR TRANSFERRING BRISTLE FILAMENTS

(71) Applicant: Zahoransky AG, Todtnau (DE)

(72) Inventors: Ingo Kumpf, Todtnau (DE); Florian Kiefer, Frohnd (DE); Bernhard Rees, Aitern (DE); Christoph Albrecht, Todtnau-Aftersteg (DE)

(73) Assignee: Zahoransky AG, Todtnau (DE)

( * ) Notice: Subject to any disclaimer, the term of this patent is extended or adjusted under 35 U.S.C. 154(b) by 521 days.

(21) Appl. No.: 14/903,167

(22) PCT Filed: Jul. 3, 2014

(86) PCT No.: PCT/EP2014/001829
§ 371 (c)(1),
(2) Date: Jan. 6, 2016

(87) PCT Pub. No.: WO2015/010767
PCT Pub. Date: Jan. 29, 2015

(65) Prior Publication Data

US 2016/0157599 A1 Jun. 9, 2016

(30) Foreign Application Priority Data

Jul. 24, 2013 (DE) ..... 10 2013 012 260

(51) Int. Cl.
*A46D 3/08* (2006.01)

(52) U.S. Cl.
CPC ..... *A46D 3/08* (2013.01); *A46D 3/082* (2013.01)

(58) Field of Classification Search
CPC ..... A46D 3/08; A46D 1/08; A46D 3/04
See application file for complete search history.

(56) References Cited

U.S. PATENT DOCUMENTS 6,832,819 B1 * 12/2004 Weihrauch ..... A46B 3/06 15/167.1

FOREIGN PATENT DOCUMENTS

| | | |
|---|---|---|
| DE | 19745024 | 4/1999 |
| DE | 10160220 | 6/2003 |

* cited by examiner

*Primary Examiner* — Michael Jennings
(74) *Attorney, Agent, or Firm* — Volpe and Koenig, P.C.

(57) ABSTRACT

A transfer station for bristle filaments that are fed to the transfer station in bristle bundles is provided. The bristle filaments are assembled in bundle form by at least one band and are transferred to a magazine in which the bristle filaments are stored. The transfer station has at least two pairs of gripping fingers spaced apart from one another in the longitudinal direction of the bundles, with the gripping fingers of the gripping-finger pairs being movable relative to one another in order to grip a bristle bundle by a distance between said gripping fingers being reduced. The gripping-finger pairs grip the bristle bundle such that the band of the bristle bundle is arranged between adjacent gripping-finger pairs. This makes it possible for the bristle filaments fed in bundle form to be transferred in an automated manner to the magazine arranged upstream of a stuffing tool of a brush-production machine.

26 Claims, 3 Drawing Sheets

Fig. 11
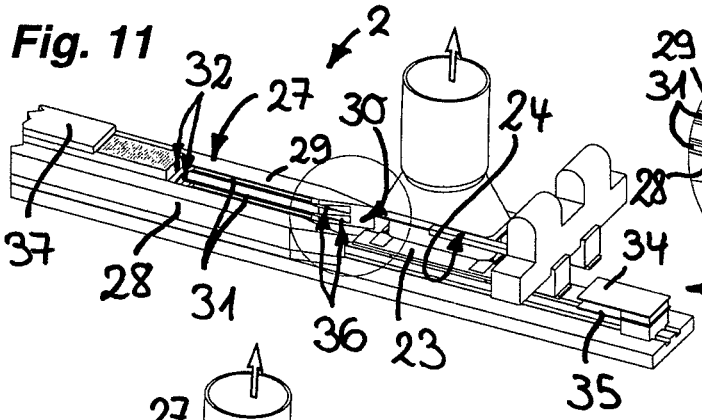
Fig. 12
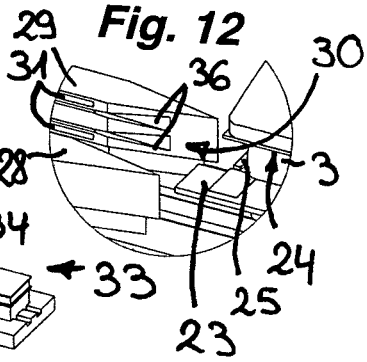
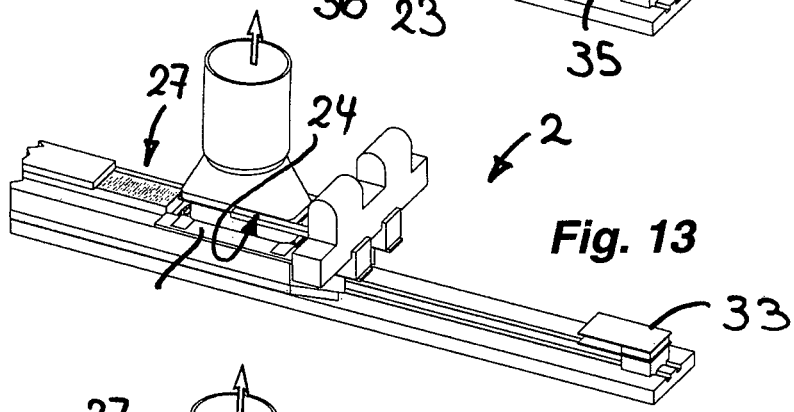
Fig. 13
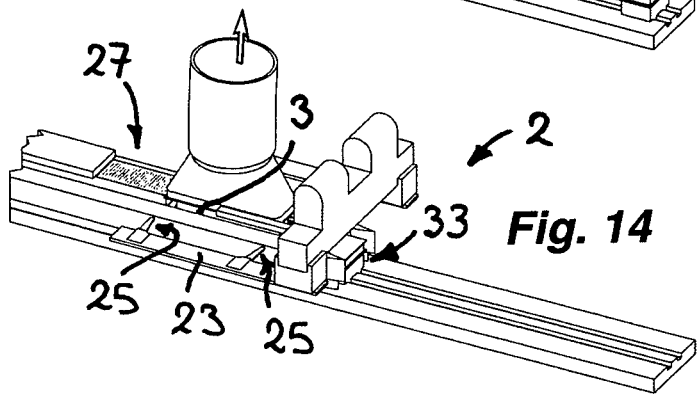
Fig. 14
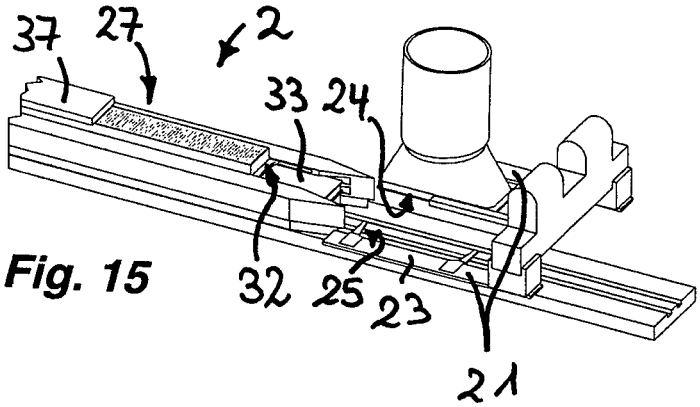
Fig. 15

TRANSFER STATION FOR TRANSFERRING BRISTLE FILAMENTS

BACKGROUND

The present invention relates to a transfer station for transferring bristle filaments which are infeedable to the transfer station in bristle bundles, said bristle bundles gathering the bristle filaments as a bundle via at least one band, to a magazine, the bristle filaments being stored in said magazine.

In brush-making machines bristle filaments are inserted into a brush body. The bristle filaments which are inserted into the brush body subsequently form the bristle field of a brush.

A brush-making machine having a multi-compartment magazine for infeeding bristle bundles from dissimilar bristle reserves to a bundle separator for a stuffing tool is known from DE 197 45 024 A1, the bundle separator having a separator notch. The multi-compartment magazine has a plurality of infeeding ducts which may be filled with the aid of a loading installation for bristle material. The loading installation has a storage magazine which has a number of obliquely disposed receptacle compartments for in each case a plurality of bristle bundles, said number corresponding to the number of magazine infeeding ducts. Here, the individual bristle bundles are sheathed with a covering, for example of paper, which prior to the bristle material being infed to the infeeding ducts is removed in that gripping pliers retrieve the bristle material from the covering. The uncovered bristle material may then be taken over to the uncovering station by an infeeding gripper and deposited into one of the infeeding ducts.

A further brush-making machine having a stuffing installation which has a bundle separator having a separator notch has been previously known from DE 101 60 220 A1. The bundle separator is assigned a multi-compartment magazine having a plurality of infeeding ducts for bristles. A storage installation for bristles is provided so as to be spatially removed from the multi-compartment magazine. Here, an intermediate conveying installation having a gripper serves for the removal of bristles from the storage installation and for the transfer thereof into one of the infeeding ducts of the multi-compartment magazine.

In the case of these two brush-making machines which per se have been successful, the bristle material with the aid of the loading installation or with the aid of the intermediate conveying installation, respectively, may be removed from the bristle reserve and transferred to the magazine in an automated manner, since the bristle material which is processed on these brush-making machines is composed of bristle filaments which across their entire length are cylindrically configured.

Chemically tapered bristle filaments which are also referred to as "tapered filaments" have already been created. These tapered bristle filaments which taper off in a wafer-thin bristle tip are increasingly used on a world-wide scale in order for particularly soft toothbrushes to be achieved therewith. Since these bristle filaments are particularly thin, such tapered bristle filaments are to this day still manually placed into the magazine of a brush-making machine. Such a magazine which is also referred to as a material hopper has at least one conveying track which on both sides is delimited by a side strip and which is disposed upstream of a stuffing tool of the brush-making machine.

The chemically tapered bristle elements are typically offered in bristle bundles which are mostly consolidated so as to be of a round cross section. The bristle filaments of a bristle bundle here are held together by at least one band and preferably by at least one rubber band. During manual placing of the bristle filaments which are still held together as a bundle the bristle bundle is put on the base plate of the magazine and subsequently indexed between the side strips of a conveying track which is provided in the magazine up to pushers which are displaceable on both sides of the side strips. Thereafter, the rubber bands which still hold the bristle bundles together are removed, so as to draw the pushers via pressure onto a sensor behind the bristle filaments which are now no longer in a bundle, so that the pushers can press the fresh bristle material against the bristle filaments which are already located in the conveying track. Since the tapered bristle filaments must always be well encompassed, it often arises that the pusher which laterally projects beyond the side strips also pushes onto the fingers. Since the pressure acting on the pusher is not very high, only slight pressure points arise. Since the brush-making machine during the placing phase of the bristle bundles should not be stopped, the magazine moves when switching over from one bristle color to another bristle color has to take place. Due to this, serious pinching may arise, also due to lack of attention of the operator. Such pinching and the injuries to the operator related thereto must, however, be positively avoided.

SUMMARY

There is, therefore, in particular the object of achieving a transfer station of the type mentioned at the outset which permits automated transferring of the bristle filaments which are supplied as a bundle to the magazine which is disposed upstream of the stuffing tool of a brush-making machine, for example.

The solution according to the invention in the transfer station of the type mentioned at the outset particularly lies therein that the transfer station has at least two pairs of gripper fingers which are spaced apart from one another in the longitudinal direction of the bundle, in that the gripper fingers of the gripper finger pairs for gripping a bristle bundle are movable transversely to the longitudinal direction of the bundle in relation to one another in such a manner that the spacing of these gripper fingers is reduced, and in that the gripper finger pairs here grip the bristle bundle in such a manner that at least one band of the bristle bundle is disposed between adjacent gripper finger pairs.

The transfer station according to the invention is intended for transferring bristle filaments to a magazine, said bristle filaments being infed to the transfer station as bristle bundles. Here, the bristle filaments of a bristle bundle are typically grouped together via at least one band. The bristle filaments are subsequently stored in a non-bundled manner in the magazine. The transfer station according to the invention has at least two pairs of gripper fingers, said gripper finger pairs being mutually spaced apart in the longitudinal direction of the bundle. The gripper fingers of the gripper finger pairs are movable in relation to one another in such a manner that the spacing of these gripper fingers may be reduced in order for the bristle filaments to be loosely clamped or held, respectively, between the gripper fingers of each of the gripper finger pairs. The provided bristle bundle here is acquired in such a manner that at least one band of the bristle bundle is disposed between adjacent gripper finger pairs. The transfer station according to the invention has at least one band opener which is intended for opening the at least one band of a bristle bundle acquired by the gripper finger pairs. The gripper finger pairs which are mutually spaced apart in the longitudinal extent of the bristles permit the bristle filaments which are delivered in bundles to be unwrapped, due to which automated transferring of the bristle filaments to a magazine which subsequently stores the bristle filaments in a non-bundled manner is enabled.

In order for a bristle bundle which is held between the gripper finger pairs to be released from the at least one band enclosing the bristle bundle, it is advantageous for the transfer station to have at least one band opener for opening the at least one band of a bristle bundle acquired by the gripper finger pairs.

Here, preferred embodiments according to the invention provide that the at least one band opener is configured as a knife, as scissors, or as pliers.

In order for the band which has been opened in this manner to be able to be removed from the region of the bristle filaments, it is advantageous for the at least one band opener to be assigned a band gripper which acquires the band to be opened by the band opener. After the band has been opened by the band opener the band gripper may move the band laterally past the bristle filaments and remove said band.

Instead of such a band gripper, another advantageous embodiment according to the invention provides that the at least one band opener is assigned a suction installation which suctions the band opened by the band opener and conveys said band away by a suction flow.

In order to not cause an obstruction when the band is opened with the aid of the band opener, it is expedient for the band gripper or the suction installation to be disposed on the side of a bristle bundle that faces away from a band opener.

It is possible for the gripper finger pairs of the transfer station to grip the respective bristle bundle in a position in which the bristle filaments by way of their longitudinal extent are oriented approximately in the horizontal direction. However, an embodiment in which the gripper finger pairs grip the respective bristle bundle in a position in which the longitudinal direction of the bristles is oriented approximately in the vertical direction is preferred.

Since individual bristle filaments may fall out and go astray even from the bristle bundle which is encompassed by at least one band, it is advantageous for the bristle bundles in the region of the gripper finger pairs to be disposed so as to have the one bundle end side thereof on a supporting element. It is ensured in this way that not even a single bristle filament of a bristle bundle which is held by the gripper finger pairs may fall down and go astray.

In order for the bristle bundles in the region of the gripper finger pairs to be moved and for the bristle bundles to be infed to the transfer station, it is advantageous for the supporting element to be configured as a conveyor belt, said conveyor belt infeeding the bristle bundles to the gripper finger pairs.

In order for the bristle filaments which are still being held between the gripper finger pairs and are optionally already relieved from the at least one band to be able to be conveyed and moved in the direction of the magazine, it may be advantageous for the bristle bundles located on the supporting element on that end side thereof that faces away from the supporting element to be acquirable by a suction plate.

Here, one preferred embodiment according to the invention provides that the suction plate has a Dutch-weave fabric which is perfusable by the suction flow of a suction blower. Such a Dutch-weave fabric has a structure which is fine in such a manner that the bristle filaments are indeed not sucked through the Dutch-weave fabric but instead in the suction flow of the suction blower are caught in the Dutch-weave fabric. This suction flow may pass through the Dutch-weave fabric by way of the openings which are formed by the woven-fabric structure.

In order for the bristle bundles to be able to be de-bundled in an orderly manner and the bristle filaments which are as yet still infed as a bundle to be able to be handed over to the magazine, it is advantageous for the bristle bundles on the supporting element which is configured as a conveyor belt to be kept so as to be spaced apart, and to this end for at least one bristle bundle stopper which is displaceable or pivotable between a standby position and a holding position projecting into the conveying path of the conveyor belt to be provided. This at least one bristle bundle stopper which in terms of control is linked to at least one light barrier or a similar optical bristle-bundle detector is capable of extending the spacing between the bristle bundles located on the supporting element to the desired spacing. In order to be able to hand over the bristle filaments which have been relieved from the at least one band to the magazine, it is expedient for a further gripper finger pair which takes over the bristle filaments to be interjectable into the intermediate space which is disposed between gripper finger pairs which are spaced apart in the longitudinal direction of the bundle. While the bristle filaments which have been relieved in this manner from the band stick to the suction plate, the bristle filaments adhering to the suction plate are held together by the at least one further gripper finger pair which is interjectable into the intermediate space of the gripper finger pairs described above, which are spaced apart in the longitudinal direction of the bundle.

In order to impart a certain external contour to the bristle filaments which are held together by at least one band and indeed to the bristle filaments which have been relieved of the at least one band, said external contour facilitating handling of these bristle filaments, it is advantageous for on at least one gripper finger of at least one gripper finger pair at least one longitudinal delimitation which projects beyond the gripper finger so as to be lateral to the adjacent gripper finger of the gripper finger pair to be provided.

Here, one preferred embodiment according to the invention provides that at least one longitudinal delimitation is held so as to be adjustable on the gripper finger.

In order for the bristle filaments which have been de-bundled in the transfer station to be able to be infed to the magazine and subsequently to be stored in the magazine, it is advantageous for the magazine to have at least one conveying track in which the bristle filaments which are oriented in the vertical direction are disposed between two side strips.

Threading of the bristle filaments into the conveying track which is delimited by two side strips is facilitated when the at least one conveying track has an introduction region in which the spacing of the side strips which delimit the conveying track is reduced in the conveying direction.

In order for the bristle filaments which are stored in a conveying track to be held and secured in their position which is oriented in the vertical direction, it is expedient for the bristle filaments which are located in the at least one conveying track to be held by at least one pusher which laterally projects beyond a side strip and is preferably displaceable along this side strip.

Here, handling of the de-bundled bristle filaments in the region of the at least one conveying track is further facilitated when a laterally projecting pusher is provided on each side strip.

In order for the bristle filaments to be able to be indexed in the conveying track and to be moved in the direction of a stuffing tool, for example, it is advantageous for each conveying track to be assigned a slider which is displaceable between the side strips of this conveying track.

Handling of the bristle filaments which are oriented in the vertical direction is facilitated and secured also in the region of the conveying track of the magazine when at least one slider has at least two slider fingers which are mutually spaced apart in such a manner that the at least two slider fingers are placeable so as to bear on the bristle filaments and to be spaced apart in the longitudinal direction of the latter. In this embodiment the slider has at least two slider fingers which in the longitudinal extent of the bristles engage on the adjacent bristle filaments so as to be mutually spaced apart.

Additionally or alternatively to the already mentioned supporting element, it may be expedient for the transfer station to have at least one supporting element which is preferably configured as a conveyor belt for providing and/or infeeding bristle filaments which are held together as bristle bundles by at least one band and/or by a sheathing, wherein the at least one supporting element may be assigned at least one gripper installation having at least one holding and retrieval gripper and at least one removal gripper. The at least one gripper installation having the at least one holding and retrieval gripper may be specified for acquiring a bristle bundle, which is provided on this supporting element and/or an infed bristle bundle, and for at least partially retrieving the band and/or the sheathing, and the at least one removal gripper may be specified for acquiring a bundle portion which is relieved from the at least one band and/or the sheathing and for removing and conveying the bristle bundle onward. Onward conveying of the bristle bundle which has been relieved of the band and/or of the sheathing may then be performed to a, for example the already mentioned, magazine, or also directly to a brush-making machine which is disposed downstream of the transfer station, in particular to a stuffing tool of a brush-making machine.

One particularly advantageous embodiment according to the invention provides that the transfer station is disposed so as to be upstream of the stuffing tool of a brush-making machine.

Refinements according to the invention are derived from the claims in conjunction with the description of the figures and the drawings. The invention will be explained in yet more detail hereunder with reference to a preferred exemplary embodiment.

BRIEF DESCRIPTION OF THE DRAWINGS

In the drawings:

FIG. 11 shows the magazine which here is illustrated in a simplified manner by the conveying track, the bristle filaments which are being held by the further gripper finger pair as well as by the suction plate being introduced into the conveying track of the magazine;

FIG. 12 shows an introduction region which is intended for introducing the bristle filaments into the conveying tack, in a detail view;

FIG. 13 shows the bristle filaments which have now been introduced into the conveying track immediately prior to removal of the further gripper finger pair and of the suction plate;

FIG. 14 shows the bristle filaments which have been pushed together by a slider which is indexable into the conveying track, so as to form a bristle reserve; and FIG. 15 shows the bristle filaments which are located in the bundle-free reserve, the further gripper finger pair and the suction plate having now also been removed from the former.

DETAILED DESCRIPTION OF THE PREFERRED EMBODIMENTS

Figure 1:
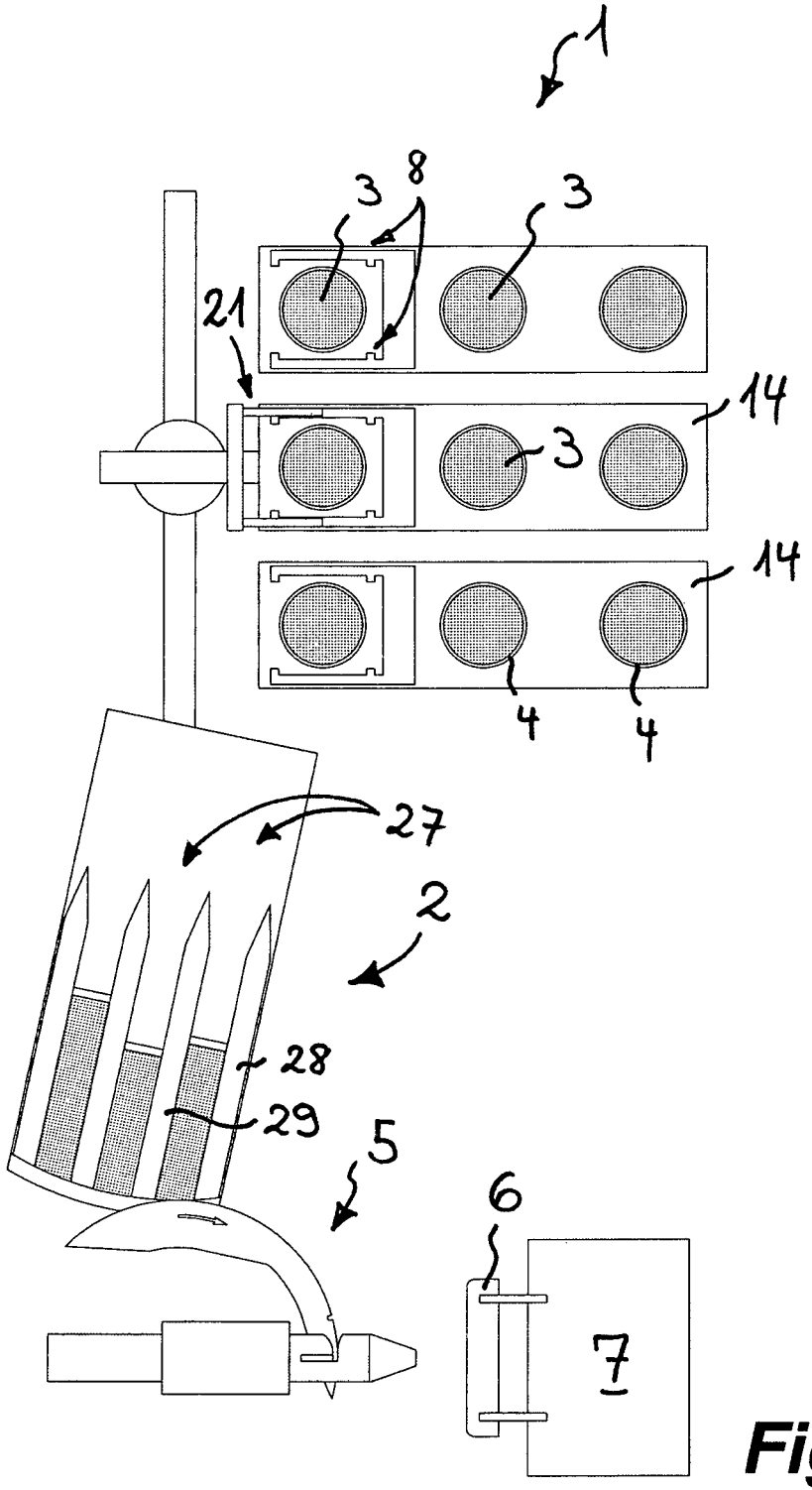
FIG. 1 shows a brush-making machine which is intended for processing chemically tapered bristle filaments, the brush-making machine having a transfer station from which the bristle filaments which are infed as a bundle are transferred to a magazine, said magazine being disposed upstream of a stuffing tool of the brush-making machine.

The details of a transfer station 1 which is intended for transferring bristle filaments which are infed as a bundle to a magazine 2 which subsequently stores the bristle filaments in a de-bundled manner are illustrated in FIGS. 1 to 15. Such bristle filaments are typically offered as bristle bundles 3 in which the bristle bundles are held together by at least one band and in particular by at least one rubber band 4. For example, the magazine 2 may be disposed upstream of a stuffing tool 5 of a brush-making machine, said stuffing tool 5 removing a part-quantity of bristle filaments from the reserve which is located in the magazine 2, so as to subsequently insert the bristle filaments into a brush body 6 which is provided in the brush-making machine. To this end, the brush body 6 by means of a positioning device 7 is positioned ahead of the stuffing tool 5.

It can be seen in FIGS. 1, 2, and 5 to 8 that the transfer station 1 has at least two pairs 8, 9 of gripper fingers 10, 11; 12, 13 which are mutually spaced apart in the longitudinal direction of the bristle bundles. In order to grip an infed bristle bundle 3, the gripper fingers 10, 11; 12, 13 of the gripper finger pairs 8, 9 here are movable in relation to one another in a transverse manner to the longitudinal direction of the bundle in such a manner that the mutual spacing of the gripper fingers 10, 11; 12, 13 is reduced. If the spacing of the gripper fingers 10, 11; 12, 13 of each of the gripper finger pairs 8, 9 is reduced, the bristle bundle 3 is deformed from the original shape which is round in cross section and is depicted on the left side in FIG. 10 into the shape which is shown on the right side in FIG. 10 and is now elongate. The gripper finger pairs 8, 9 here grip the bristle bundle 3 in such a manner that the rubber band 4 which still holds the bristle filaments together and which in cross section is preferably out-of-the-round and preferably approximately rectangular is located between the gripper fingers 10, 11; 12, 13 of adjacent gripper finger pairs.

Figure 2:
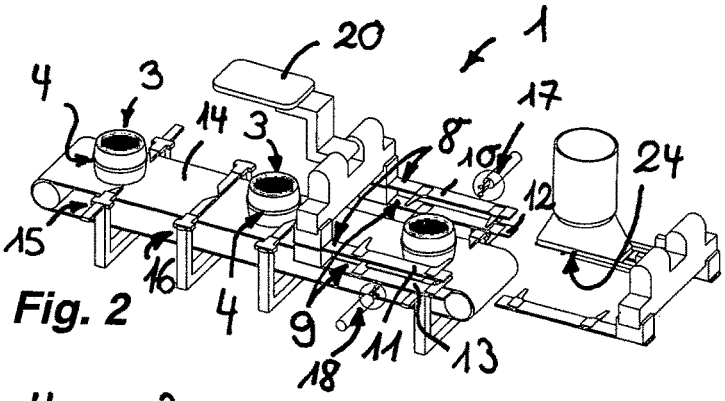
FIG. 2 shows the bristle bundles which are infed on a conveyor belt of the transfer station and which are held together in each case by a rubber band which encircles a bristle bundle in an approximately centric manner.

It can be seen in FIG. 2 that the bristle bundles 3 by way of their one bundle end side are placed on a supporting element which here is configured as a conveyor belt 14. The bristle bundles 3 are infed on the conveyor belt 14 to the transfer station 1. In order for the bristle bundles 3 to be able to be released and conveyed onward in an orderly manner, the bristle bundles 3 are set so as to be spaced apart on the conveyor belt 14. To this end, at least one bristle bundle stopper 15, 16 which is displaceable or pivotable between a standby position and a holding position which projects into the conveying path of the conveyor belt 14 is provided. The pairs of bristle bundle stoppers 15, 16 which in each case in terms of control are connected to a light barrier and here are disposed on both sides of the conveyor belt 14 make sure that the bristle bundles 3 are kept so as to be spaced apart. The bristle bundles 3 on the conveyor belt 14 are infed to the two gripper finger pairs 8, 9, said gripper finger pairs being mutually spaced apart in the longitudinal direction of the bundle. The gripper fingers 10, 11; 12, 13 of the gripper finger pairs 8, 9 are mutually displaceable or movable in relation to one another in a transverse manner to the longitudinal direction of the bundle such that the spacing of these gripper fingers 10, 11; 12, 13 is reduced and a bristle bundle which is located between the gripper fingers 10, 11; 12, 13 of the gripper finger pairs 8, 9 is securely held. Here the gripper finger pairs 8, 9 grip the bristle bundle 3 in such a manner that the at least one rubber band 4 which holds together the bristle filaments of a bristle bundle 3 is disposed between adjacent gripper finger pairs 8, 9.

It is indicated in FIG. 2 that the transfer station has at least one band opener 17 which here is designed as scissors. The band opener 17 is provided for opening the at least one rubber band 4 which surrounds the bristle bundle which is being gripped by the gripper finger pairs 8, 9. While the band opener 17 which is configured as scissors severs the at least one rubber band 4, the rubber band 4 on that side of the bristle bundle 3 that faces away from the band opener 17 is held by a pliers-type band gripper 18 which subsequently pulls and conveys away the cut-open rubber band 4 past the bristle bundle. The rubber band 4 is subsequently dropped into a waste container. Instead of the band gripper 18, direct suctioning of the cut-open rubber band 4 may also be provided. In the case of the band opener 17 and of the band gripper 18 a circular filament displacement element 19 which makes sure that individual bristle filaments are not severed in addition to the rubber band 4 or jammed is provided at the tip of the scissor arms or pliers arms, respectively.

Figure 3:
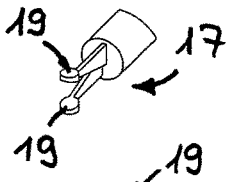
FIG. 3 shows a band opener which is provided for cutting open the rubber band and which here is configured as scissors.
Figure 10:
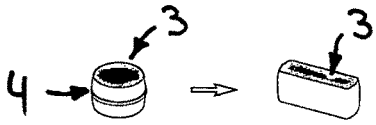
FIG. 10 shows the bristle filaments which are initially held by a rubber band so as to be in a round bristle bundle and which are now, post removal of the rubber band, held between the gripper finger pairs in an elongate shape which already preempts the shape of the conveying track of the magazine.

In FIG. 3 the bristle bundle 3 is deformed in a subsequent method step. When the gripper fingers 10, 11; 12, 13 converge, the bristle bundle 3 which in cross section is initially still round is deformed in such a manner that in terms of its cross section it assumes the elongate shape which is shown in FIG. 10. Prior to this deformation taking place, a cover plate 20 is pivoted or moved in such a manner that the latter is held over the bristle bundle 3, so as to prevent even a single bristle filament escaping. The deformation of the bristle filaments which are still held together as a bundle by the gripper finger pairs 10, 11; 12, 13 is performed by the two gripper finger pairs 8, 9.

Figure 4:
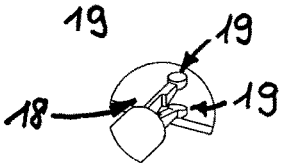
FIG. 4 shows a pliers-type band gripper which is intended for acquiring and conveying away the cut-open rubber band.

It is indicated in FIG. 4 that a further gripper finger pair 21 having gripper fingers 22, 23, which takes over the bristle filaments which are now no longer held by a rubber band 4, is interjectable into the intermediate space which is provided in the longitudinal direction of the bundle between the gripper finger pairs 8, 9. At the same time a suction plate 24, which by way of a suction flow holds the bristle filaments at the ends thereof, is moved over that end side of the bristle filaments that faces away from the supporting element. This suction plate 24 has a Dutch-weave fabric which is fine in such a manner that the bristle filaments cannot be suctioned through the suction plate.

Figure 5:
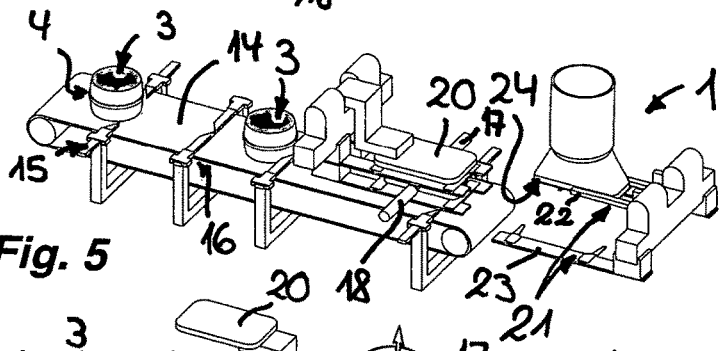
FIG. 5 shows the conveyor belt of FIG. 2 from which a bristle bundle is gripped with the aid of gripper finger pairs.
Figure 6:
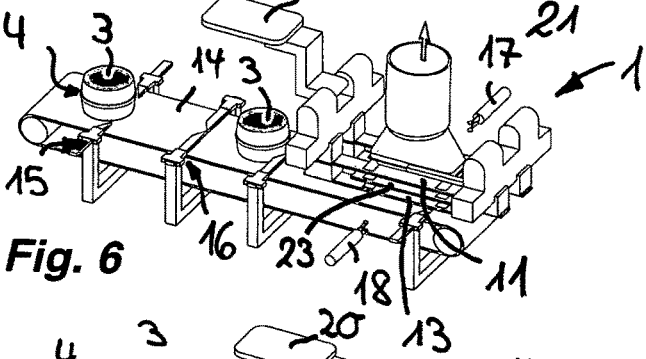
FIG. 6 shows the bristle bundle, which according to FIGS. 2 and 5 has been gripped and is now relieved from the rubber band, on the conveyor belt, and which here is gripped by a further gripper finger pair and by a unilaterally disposed suction plate.
Figure 7:
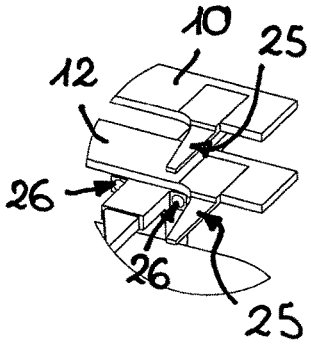
FIG. 7 shows the gripper finger pairs which are mutually spaced apart in the longitudinal direction of the bristles, in a detail view in the region of an adjustable longitudinal delimitation.
Figure 8:
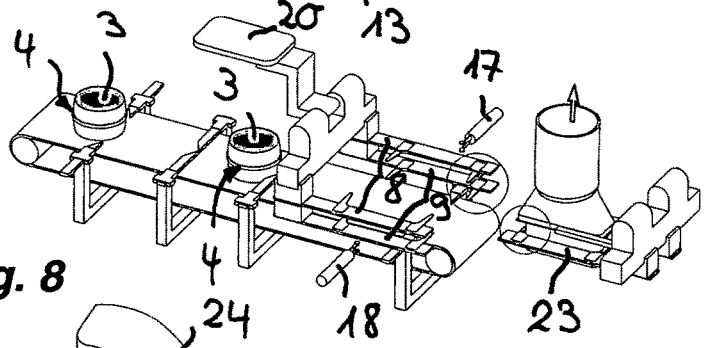
FIG. 8 shows the bristle filaments which are held between the further gripper finger pair and suctioned so as to be on the suction plate, prior to being transferred to the magazine which is disposed upstream of the stuffing tool.
Figure 9:
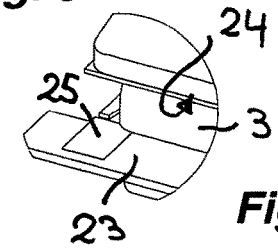
FIG. 9 shows the bristle filaments which are held between the further gripper finger pair and suctioned by the suction plate, in a detail view.

In FIG. 5 the gripper finger pair 21 and the suction plate 24 have removed the bristle filaments which have been relieved of the rubber band from the infeed which is formed by the conveyor belt 14 and by the gripper finger pairs 8, 9, so as to now move these bristle filaments to the magazine. In FIG. 7 the construction of a gripper finger pair is shown in detail by the gripper finger pairs 8, 9. As can be seen, a longitudinal delimitation 25 which in each case laterally projects over the gripper finger toward the adjacent gripper finger of the gripper finger pair 8 or 9 is provided on each gripper finger on both sides of the bristle filaments. This longitudinal delimitation which is held so as to be displaceable or adjustable on the gripper finger assigned to the former, in relation to the gripper finger that supports the longitudinal delimitation 25 has an obtuse angle, for example an angle of 100 degrees. Light barriers 26 which signal the presence of the bristle filaments are also provided in the region of the gripper finger pairs 8, 9.

The gripper finger pair 21 and the suction plate 24 subsequently move the bristle filaments to the magazine 2 shown in FIGS. 1 to 15. The magazine 2 has at least one conveying track 27, the bristle filaments which have been relieved of the bands 4 being stored in said conveying track 27. The conveying track 27 has two side strips 28, 29 which are mutually spaced apart and which guide the bristle filaments which are oriented in the longitudinal direction of the bristles.

The conveying track 27 has an introduction region 30 in which the spacing of the side strips 28, 29 which delimit the conveying track 27 is reduced in the conveying direction. In FIGS. 11 and 13 the bristle filaments which are held on the gripper finger pair 21 and on the suction plate 24 in the introduction region 30 between the two side strips 28, 29 are pushed into the conveying track 27. Direct placing from above between the side strips 28, 29 is also possible if and when the spacing between the side strips 28, 29 is larger than the cross section of the bristle filaments which are held together in an elongate shape.

In the conveying track 27 the bristle filaments are held by way of at least one pusher which laterally projects beyond a side strip 28, 29 and is displaceable along these side strips 28, 29. It can be seen in FIGS. 11 and 13 that the side strip 28 has two pusher ducts 31 in which in each case one pusher 32 is displaceable, and that the pushers 32 which are displaceable on the side strip 28 and pivotable into a holding position in the conveying track 27 are mutually spaced apart in the longitudinal direction of the bristles.

The conveying track 27 is also assigned a slider 33 which is displaceable between the side strips 28, 29 of the conveying track 27 and compresses the bristle filaments which are stored there. This slider 33 here has at least two slider fingers 34, 35 which are mutually spaced apart in the longitudinal direction of the bristles and which in the side strips 28, 29 are guided in slider ducts 36. The slider ducts 36 in the introduction region 30 are configured so as to be funnel-shaped, so as to be able to acquire and receive the slider fingers 34, 35.

The bristle filaments which in FIG. 14 are situated in the conveying track 27 there are lowered up to a base plate of the conveying track 27 and pushed against the pushers 32. In order to ensure secure holding of the bristle filaments here, the pusher 33 is placed to bear on the bristle pack from behind. The gripper finger pair 21 may subsequently be removed, such that the slider 33 now presses the bristle pack against the two pushers 32. The two pushers are laterally removed, so as to be able to again be pivoted parallel with the slider 33 into their holding position behind the newly infed bristle pack, the entire bristle reserve now being held together by the pushers 32 in said holding position.

The gripper finger pair 21 and the suction plate 24 have been removed from the region of the bristle filaments in FIG. 15. It is indicated in FIGS. 11 and 13 to 15 that a contact element 37 is assigned to the conveying track 27. This contact element 37 in the longitudinal direction of the bristles is movable by a few millimeters between an upper and a lower contact element position, the bristle filaments being impinged in the lower contact element position at the free bristle ends of said bristle filaments. Impinging the bristle filaments stored in the conveying track 27 is intended to prevent that individual bristle filaments move upward while being moved onward in the conveying track 27. In order for a protrusion of this type of individual bristle filaments to be effectively prevented it is advantageous for the contact element 37 to extend across the entire region of the bristle material which is stored in the conveying track 27.

In one embodiment of the transfer station 1, which is not illustrated in the figures, said transfer station 1 is provided with at least one further supporting element which is preferably configured as a conveyor belt for providing and/or infeeding bristle filaments which are held together as bristle bundles 3 by at least one band and/or by a sheathing. This at least one further supporting element is assigned a gripper installation having at least one holding and retrieval gripper and at least one removal gripper. The gripper installation having the at least one holding and retrieval gripper is specified for acquiring a bristle bundle 3 which is provided and/or infed on the supporting element assigned thereto and is covered with at least one band and/or a sheathing, and for at least partially retrieving the band and/or the sheathing. By way of the at least one removal gripper a bundle portion of the bristle bundle 3, which has been relieved of the at least one band and/or of the sheathing may be gripped and the bristle bundle 3 in this way be removed from the supporting element and conveyed onward. Onward conveying of the bristle bundle 3 is then performed, for example, to the magazine 2 and/or to a brush-making machine which is disposed downstream, in particular directly to a stuffing tool of such a brush-making machine.

The transfer station 1 illustrated here permits automated transfer of bristle filaments which have been infed as a bundle to the magazine which is disposed upstream of the stuffing tool of a brush-making machine. Since this transfer no longer has to be performed manually, unintentional pinching of and injury to the operator are prevented. The transfer station 1 shown here is particularly well suited to operation in conjunction with such bristle filaments which are processed, treated and/or marked on at least one bristle end. The transfer station 1 illustrated here in this way may be advantageously used with bristle filaments which are chemically or mechanically tapered on at least one bristle end. Such bristle filaments can have unilateral chemically tapered ends, bilateral chemically tapered ends, or unilateral or bilateral bristle ends which have been mechanically tapered. The transfer station may also be used in conjunction with such bristle filaments which have pre-rounded or spliced bristle ends. The transfer station 1 may also be used with such bristle filaments which on at least one bristle end are colored, preferably by way of a marker.

LIST OF REFERENCE SIGNS

1 Transfer station
2 Magazine
3 Bristle bundle
4 Rubber band
5 Stuffing tool
6 Bristle body
7 Positioning device
8 Gripper finger pair
9 Gripper finger pair
10 Gripper finger (of gripper finger pair 8)
11 Gripper finger (of gripper finger pair 8)
12 Gripper finger (of gripper finger pair 9)
13 Gripper finger (of gripper finger pair 9)
14 Conveyor belt
15 Bristle bundle stopper
16 Bristle bundle stopper
17 Band opener
18 Band gripper
19 Filament displacement element
20 Cover plate
21 Gripper finger pair
22 Gripper finger (of gripper finger pair 21)
23 Gripper finger (of gripper finger pair 21)
24 Suction plate
25 Longitudinal delimitation (on the gripper fingers)
26 Light barrier
27 Conveying track
28 Side strip
29 Side strip
30 Introduction region
31 Pusher ducts
32 Pusher
33 Slider
34 Slider finger
35 Slider finger
36 Slider ducts
37 Contact element

The invention claimed is:

1. A transfer station (1) for transferring bristle filaments which are infeedable to the transfer station in bristle bundles (3), said bristle bundles (3) gathering the bristle filaments as a bundle via at least one band (4), to a magazine (2), the bristle filaments being stored in said magazine (2), the transfer station (1) comprising at least two pairs (8, 9) of gripper fingers (10, 11; 12, 13) which are spaced apart from one another in a longitudinal direction of the bundle, the gripper fingers (10, 11; 12, 13) of the gripper finger pairs (8, 9) for gripping and transferring a bristle bundle (3) are configured to be movable in relation to one another in such a manner that a spacing of said gripper fingers (10, 11; 12, 13) is reduced, the bristle bundle (3) to be gripped during transfer is gripped by all of the gripper fingers (10, 11; 12, 13) of the gripper finger pairs (8, 9), and the gripper finger pairs (8, 9) here grip the bristle bundle (3) in such a manner that the at least one band (4) of the bristle bundle (3) is disposed between adjacent gripper finger pairs (8, 9).

2. The transfer station as claimed in claim 1, further comprising at least one band opener (17) for opening the at least one band (4) of a bristle bundle (3) acquired by the gripper finger pairs (8, 9).

3. The transfer station as claimed in claim 2, wherein the at least one band opener (17) is configured as a knife, as scissors, or as pliers.

4. The transfer station as claimed in claim 2, wherein the at least one band opener (17) is assigned a band gripper (18) which acquires the band (4) to be opened by the band opener (17).

5. The transfer station as claimed in claim 4, wherein the at least one band opener (17) is assigned a suction installation which suctions the band (4) opened by the band opener (17) and conveys said band (4) away by a suction flow.

6. The transfer station as claimed in claim 5, wherein the band gripper (18) or the suction installation is disposed on a side of a bristle bundle (3) that faces away from a band opener (17).

7. The transfer station as claimed in claim 1, wherein the bristle bundles (3) in a region of the gripper finger pairs (8, 9) are disposed so as to have a bundle end side thereof on a supporting element.

8. The transfer station as claimed in claim 7, wherein the supporting element is configured as a conveyor belt (14), said conveyor belt (14) infeeding the bristle bundles (3) to the gripper finger pairs (8, 9).

9. The transfer station as claimed in claim 7, wherein the bristle bundles (3) or bristle filaments located on the supporting element on an end side thereof that faces away from the supporting element are acquirable by a suction plate (24).

10. The transfer station as claimed in claim 9, wherein the suction plate (24) comprises a Dutch-weave fabric which is perfusable by a suction flow of a suction blower.

11. The transfer station as claimed in claim 7, wherein the bristle bundles (3) on the supporting element which is configured as a conveyor belt (14) are kept so as to be spaced apart, and to this end at least one bristle bundle stopper (15, 16) which is displaceable or pivotable between a standby position and a holding position projecting into a conveying path of the conveyor belt (14) is provided.

12. The transfer station as claimed in claim 1, further comprising a further gripper finger pair (21) which takes over the bristle filaments is interjectable into an intermediate space which is disposed between gripper finger pairs (8, 9) which are spaced apart in the longitudinal direction of the bundle.

13. The transfer station as claimed in claim 12, wherein on at least one of the gripper fingers (10, 11; 12, 13; 22, 23) of at least one of the gripper finger pairs (8, 9, 21) at least one longitudinal delimitation (25) which projects beyond the gripper finger so as to be lateral to the adjacent gripper fingers of the gripper finger pair is provided.

14. The transfer station as claimed in claim 13, wherein the at least one longitudinal delimitation (25) is held so as to be adjustable on the gripper finger (10, 11; 12, 13; 22, 23).

15. The transfer station as claimed in claim 1, wherein the magazine (2) which has at least one conveying track (27) in which the bristle filaments which are oriented in a vertical direction are disposed between two side strips (28, 29).

16. The transfer station as claimed in claim 15, wherein the at least one conveying track (27) has an introduction region (30) in which a spacing of the side strips (28, 29) which delimit the conveying track (27) is reduced in the conveying direction.

17. The transfer station as claimed in claim 15, wherein the bristle filaments which are located in the at least one conveying track (27) are held by at least one pusher which laterally projects beyond one of the side strips (28, 29) and is displaceable along said side strip (28, 29).

18. The transfer station as claimed in claim 17, wherein an at least unilaterally projecting pusher (32) is provided on each of the side strips (28, 29).

19. The transfer station as claimed in claim 15, wherein each of the conveying tracks (27) is assigned a slider (33) which is displaceable between the side strips (28, 29) of said conveying track (27).

20. The transfer station as claimed in claim 19, wherein the at least one slider (33) has at least two slider fingers (34, 35) which are mutually spaced apart such that the at least two slider fingers (34, 35) are placeable so as to bear on the bristle filaments and to be spaced apart in the longitudinal direction of the latter.

21. The transfer station as claimed in claim 1, wherein the transfer station (1) is disposed upstream of a stuffing tool (6) of a brush-making machine.

22. The transfer station as claimed in claim 1, wherein en the transfer station (1) is configured for transferring bristle filaments which are at least one of processed, treated or marked on at least one bristle end.

23. The transfer station as claimed in claim 1, wherein the transfer station (1) is configured for transferring bristle filaments which are chemically or mechanically tapered on at least one bristle end.

24. The transfer station as claimed in claim 1, wherein the transfer station (1) is configured for transferring bristle filaments which have a spliced or pre-rounded bristle end on at least one bristle end.

25. The transfer station as claimed in claim 1, wherein the transfer station (1) is configured for transferring bristle filaments which on at least one bristle end have a bristle end which is colored by a marker.

26. The transfer station as claimed in claim 1, further comprising at least one supporting element which is configured as a conveyor belt for at least one of providing or infeeding bristle filaments which are held together as bristle bundles (3) by the at least one band or by a sheathing, said supporting element being assigned a gripper installation having at least one holding and retrieval gripper and at least one removal gripper, wherein the gripper installation includes the at least one holding and retrieval gripper for acquiring a bristle bundle (3), which is provided on the at least one supporting element or an infed bristle bundle (3), and for at least partially retrieving the band or the sheathing, and the at least one removal gripper is configured for acquiring a bundle portion which is relieved from the at least one band or the sheathing and for removing and conveying the bristle bundle (3) onward.

* * * * *